United States Patent [19]

Schoppe

[11] 4,324,562

[45] Apr. 13, 1982

[54] METHOD OF IMPROVING THE STORAGE SAFETY OF PULVERIZED BROWN COAL

[76] Inventor: Fritz Schoppe, Max-Rüttgers-Strasse 24, 8026 Ebenhausen, Fed. Rep. of Germany

[21] Appl. No.: 76,084

[22] Filed: Sep. 17, 1979

Related U.S. Application Data

[63] Continuation of Ser. No. 865,483, Dec. 29, 1977, abandoned.

[51] Int. Cl.[3] ..... C10L 9/00

[52] U.S. Cl. ..... 44/1 G; 44/6

[58] Field of Search ..... 44/1 G, 6

[56] References Cited

U.S. PATENT DOCUMENTS

| | | | |
|---|---|---|---|
| 2,328,147 | 7/1939 | Hyson | 44/1 R |
| 3,909,212 | 9/1975 | Schroeder | 44/1 R |
| 4,043,763 | 8/1977 | Norman | 44/1 R |

*Primary Examiner*—Sam Silverberg

*Attorney, Agent, or Firm*—Brooks, Haidt, Haffner & Delahunty

[57] ABSTRACT

A method is given with the help of which pulverized brown coal can be stored safely, that is, it can be made safe against self-ignition. The pulverized brown coal is mixed with at least 20% by weight anthracite dust until the particle mixture shows a uniform, black, anthracite-like color. Defined limits for the grain size of the pulverized brown coal and the anthracite dust must be observed.

1 Claim, 1 Drawing Figure

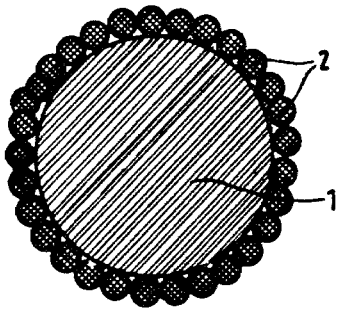
2
1

METHOD OF IMPROVING THE STORAGE SAFETY OF PULVERIZED BROWN COAL

This is a continuation of application Ser. No. 865,483, filed Dec. 29, 1977, now abandoned.

The present invention relates to a method of improving the storage safety of pulverized brown coal.

It is well known that pulverized brown coal is a reactive fuel which tends to ignite spontaneously in storage tanks. In large-scale use, as for instance at power stations, pulverized brown coal is therefore stored and handled under blanket gas and similar precautionary measures. The effort entailed has hitherto confined the use of pulverized brown coal, which is cheaper by comparison with other types of pulverized coal, to large furnaces, such as in power stations.

The energy shortage has made it economically attractive to extend the use of pulverized brown coal to the field of industrial heat generating and of larger central-heating plants, instead of using heavy oil or in part even light oil. However, storage under blanket gas is not possible in these cases because of the trouble involved, particularly because of the technical personnel who would be needed. It has therefore already been attempted to find ways of reducing the reactivity of the pulverized brown coal during storage by special measures. For instance, light oil was added to the pulverized brown coal. Taking into account the flow properties of the pulverized brown coal, however, this was only possible up to 15% by weight. The reduction in the self-ignition tendency of the pulverized brown coal thereby achieved was appreciable but by no means adequate.

The object of the invention is to provide a method of the kind initially stated, with which it is possible to store pulverized brown coal in storage tanks of the size used in the field of small furnaces, particularly for central heating, without any further protective measures.

It is possible to add to the pulverized brown coal an —in some cases relatively small—amount of for instance a less active pulverized hard coal, such as anthracite, which is much more finely-ground than the pulverized brown coal. Experiments were carried out with relatively coarse pulverized brown coal (14% over 0.2 mm; 40% over 0.063 mm) and pulverized anthracite (2% over 0.010 mm; 23% over 0.005 mm). When these substances were mixed, the following peculiar effect was observed: before mixing was started, and during the first stage of mixing, the pulverized anthracite with its greasy black color and the pulverized brown coal with its dry brown color were clearly recognizable in the mixing material, even when the mixing had so far progressed that only individual streaks of pulverized brown coal could be seen. The mixture was at this stage still very inhomogeneous, particularly with respect to its flow properties. After a certain mixing time there was a visible change of color, the color of the pulverized brown coal suddenly disappeared and the material completely took on the color and the flow properties of the anthracite. Experiments in heat-insulated, pressure-sealed containers at various storage temperatures showed that up to 100° C. no measurable reactions or development of gases took place, although this would otherwise, with pure pulverized brown coal at this temperature, have set in after a few hours.

The mixing of pulverized brown coal with pulverized hard coal is not unknown in itself. Formerly, attempts were made to add small quantities of pulverized brown coal to certain less reactive types of pulverized hard coal, to improve the ignition properties. Despite the relatively large proportion of pulverized hard coal, and particularly in larger storage tanks, spontaneous ignitions occurred which were obviously caused by the added pulverized brown coal, even if small sample quantities behaved in a more harmless manner.

Although according to the invention the amount of brown coal is several times the amount of anthracite, the dangerous nature of the brown coal has, strangely enough, been neutralized. This is obviously connected with a protective effect created by the additive on the pulverized brown coal, to which an explanation will be given later.

This protective effect can also be created with other inorganic pulverized substances, particularly those which have a certain surface activity. From the technical point of view of combustion this would also sometimes be a disadvantage because of the increased total amount of ash developed, and the heat loss which it entails, but even with this, thoroughly desirable side-effects can be obtained, as will be explained later. From the point of view of energy balance, the use of a combustible substance surrounding the brown coal grain, such as a finely-ground coal which is slow to react, in particular pulverized anthracite, is mot suitable, which is the reason why the specification primarily concentrates on this.

Of major importance is the ratio of the grain size between the pulverized brown coal and the hard coal. According to observations made up to now, the protective effect only occurs when a certain minimum proportion of fine grains is present in the pulverized anthracite. This evidently envelops the larger brown coal grains in a fine, less reactive protective layer. The quantity of pulverized anthracite required for this will depend upon the ratio between the grain sizes. In the above given example of a grain size ratio of about 1:10, the minimum quantity of pulverized anthracite required to achieve the protective effect was about 20%. If the pulverized anthracite is coarser, a larger quantity will be needed, but an upper limit for the grain size of the pulverized anthracite is set by the fact that as the grain size increases the surface forces decrease, and thus the protective effect becomes weaker. If it is more finely-ground, or if a relatively great proportion of fine grains is present, the amount of anthracite added can be reduced.

This explanation also makes it clear why, in the above-mentioned attempts to improve the ignition properties of pulverized hard coal by adding pulverized brown coal, spontaneous ignitions were always to be expected. In these attempts the two kinds of pulverized coal had not been mixed well enough for each of the brown coal grains to be completely surrounded by pulverized hard coal.

The experiments made with the present invention up to now have covered containers having a height of bed up to about 2 meters. With the usual construction of storage tanks, this corresponds to container sizes up to about 50 $m^3$, i.e. sufficient for the fields of central heating and of small and medium industrial heat generating.

The invention provides that other protective substances may also be used, particularly those which have a favorable influence on the combustion process or on the products of combustion. It is possible, for instance, to add finely ground lime or dolomite to bind sulfur or to influence the ash behavior. If necessary such substances can also be added in a small proportion which is just adequate for the sulfur binding or the ash behavior, whilst the remaining part still required to completely envelop the brown coal grain is provided by the addition or combustible substances such as pulverized anthracite.

It should be mentioned that the method of the invention can also be applied for improving the storage safety of other reactive types of pulverized coal, as for instance the types of pulverized hard coal which are rich in gas.

The FIGURE is an idealized representation of a single grain of pulverized brown coal (1) in cross-section, surrounded by a number of grains of pulverized hard coal (2) of a considerably smaller diameter. The pulverized hard coal grains (2) adhere to the pulverized brown coal grain (1) and cover it almost entirely.

What is claimed is:

1. Method of improving the storage safety of pulverized brown coal by covering brown coal particles with smaller particles of finely pulverized anthracite, wherein about 2% or less of the anthracite particles have a size over 0.010 mm and about 23% or less of the anthracite particles have a size over 0.005 mm, and wherein the brown coal particles are about ten times the size of the anthracite particles, about 14% or less of the brown coal particles having a size over 0.2 mm and about 40% or less of the brown coal particles having a size over 0.063 mm, comprising mixing such brown coal particles with at least about 20% by weight of such anthracite particles before storage and continuing mixing until the particle mixture shows a uniform, black, anthracite-like color.

* * * * *